US005479181A

United States Patent [19]

Simpson

[11] Patent Number: 5,479,181

[45] Date of Patent: Dec. 26, 1995

[54] ANTENNA TRACKING MECHANISM

[76] Inventor: J. D. Simpson, P.O. Box 738, Lakehead, Calif. 96051

[21] Appl. No.: 129,759

[22] Filed: Sep. 30, 1993

[51] Int. Cl.[6] ..... H01Q 3/00; H01Q 3/02

[52] U.S. Cl. ..... 343/882; 343/880; 343/766; 348/278.1

[58] Field of Search ..... 343/882, 765, 343/766, 763, 757, 758, 880, 881, 878; 248/183, 185, 278; 211/162; H01Q 3/00, 3/02

[56] References Cited

U.S. PATENT DOCUMENTS 4,332,426 6/1982 Speicher ..... 343/882

4,814,781 3/1989 DeHaven ..... 343/882

4,866,456 9/1989 Ebey ..... 343/766

*Primary Examiner*—Donald T. Hajec

*Assistant Examiner*—Hoanganh Le

*Attorney, Agent, or Firm*—Bielen, Peterson & Lampe

[57] ABSTRACT

A polar mounted antenna support mechanism utilizing a frame for holding the antenna. An azimuth adjusting element and an elevation adjusting element are included to appropriately move the frame and, thus, the antenna as desired. The present invention also provides the frame with a declination adjusting element having a track, which is linked to the frame. A bearing support guides the movement of the track and motivation mechanism is included for urging the track relative to the bearing surface.

14 Claims, 4 Drawing Sheets

ANTENNA TRACKING MECHANISM

BACKGROUND OF THE INVENTION

The present invention relates to a novel antenna support mechanism for a polar mounted antenna which is especially useful in tracking communications satellites.

The satellites are placed in orbits about the earth for the purpose of facilitating earth communications. Communication satellites in geostationary orbits are generally placed in an equatorial initial geostationary orbit. Such communication satellites are constantly subjected to the gravitational forces exerted by the sun, moon, and the earth. In addition, the sun produces a radiation force which strikes such communication satellites. All these forces tend to cause a communication satellite to drift away from its equatorial position.

Most geostationary communication satellites are allowed to wander 0.1 degrees in the North/South direction and 0.05 degrees in the East/West direction from assigned longitudinal positions over the earth's equator. Thrusters on such satellites are used periodically to confine satellites to these limits. In actuality, the satellite appears to follow a figure eight track as viewed from the surface of the earth. It has been found that it takes relatively little fuel in the satellite thrusters to correct for East/West drift when compared to North/South drift. Thus, inclined orbit satellites are permitted to drift a larger distance in the North/South direction, as much as 8 degrees north or south. In addition, satellites tend to gradually change their inclination angle relative to the equator.

Earth-bound satellite antennas must consequently track movements of the inclined orbit satellites in order to receive usable signals.

Some dish antennas are supported by an azimuth over elevation mount system. These systems include motorized movement on the elevation axis or on the elevation and azimuth axes. It has been found that the azimuth over elevation mount is not entirely accurate and tends to receive signals from more than one satellite at a time, requiring frequency screening.

Preferably, satellite tracking antennas utilize a polar mount or modified polar mount. In the latter case, the antenna axis mount is inclined a fraction of a degree (toward the equator) from being parallel to the polar axis of the earth. Unfortunately, this type of mount has a problem tracking inclined orbit satellites which are found east or west of a true south direction. A satellite dish tends to skew in this regard. Prior art antenna support mechanisms have included a preset declination value, relative to the polar axis. Such declination adjustment greatly increases the accuracy of a satellite tracking antenna.

A polar mounted antenna support mechanism which possesses a declination tracking or adjustment mechanism which is easily motorized would be a notable advance in the communications field.

SUMMARY OF THE INVENTION

In accordance with the present invention a novel and useful polar mounted antenna support mechanism is provided.

The mechanism of the present invention utilizes a frame which is intended for holding the antenna, that may be in the form of a dish. The mechanism of the present invention is employed with a polar mount for an antenna, which is used to monitor or track communications satellites. The polar mount includes a frame used to support the antenna. In addition, an azimuth setting system as well as an elevation setting system may be found. Such systems are of conventional configuration. The frame is also provided with a support for the antenna which may be ring-shaped.

The present invention includes as one of its elements a declination adjustment portion which includes pivotally attaching the antenna ring support to another portion of the frame. In addition, a track, which may be of curved configuration, is linked to the ring portion of the frame. A bearing surface such as a pair of rollers is used to guide movement of the track along the angle of declination. Motivation means such as a motor may be employed to urge such movement of the track and the antenna supporting ring as desired. Of course, the movement of the declination and the azimuth of the antenna may be coordinated by conventional antenna controllers. Further, the track may be formed such that a flange covers the rolling elements which serve as a bearing surface.

It may be apparent that a novel and useful antenna support system has been described.

It is therefore an object of the present invention to provide a polar mounted antenna support mechanism which is capable of tracking satellites which possess an apparent motion relative to earth based tracking systems.

It is another object of the present invention to provide a polar mounted antenna support mechanism which includes a declination adjustment mechanism which may be operated manually or by motorization.

A further object of the present invention is to provide a polar mounted antenna support mechanism which is capable of overcoming the problems associated with elevation tracking adjustments of the prior art.

A further object of the present invention is to provide a polar mounted antenna support mechanism which is capable of tracking the apparent movement of communication satellites accurately and easily, resulting in the reception of strong communication signals.

Yet another object of the present invention is to provide a polar mounted antenna support mechanism which includes a declination tracking mechanism that is reliable and repeatable over a long period of time.

The invention possesses other objects and advantages especially as concerns particular characteristics and features thereof which will become apparent as the specification continues.

For a better understanding of the invention references made to the following detailed description of the preferred embodiments which should be taken in conjunction with the prior described drawings.

DETAILED DESCRIPTION OF THE PREFERRED EMBODIMENTS

Various aspects of the present invention will evolve from the following detailed description which should be referenced to the prior described drawings.

Figure 1:
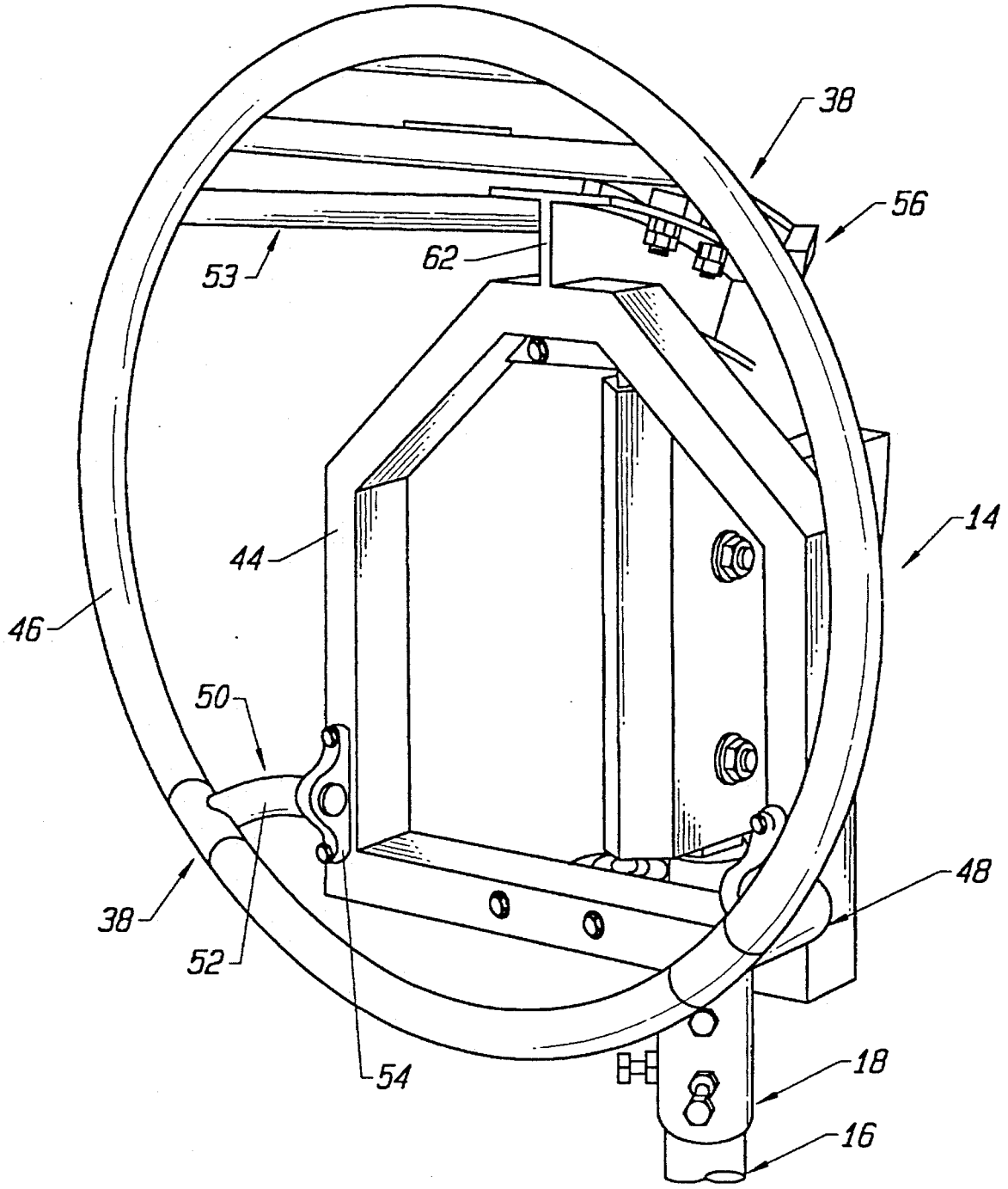
FIG. 1 is a front right isometric view of the mechanism of the present invention.

The invention as a whole is shown in the drawings by reference character 10. The mechanism 10 is employed with an antenna 12, shown partially in FIG. 3, which is fixed to a polar mount system 14, FIG. 1. Antenna 12 has been removed from FIG. 1 for the sake of clarity. Polar mount system 14 includes a post 16 which is supported on the ground surface. Post 20 extends from sleeve 18 to a plate 22 which includes an arcuate slot 24. Bolt 26, FIG. 3, travels in arcuate slot 24 and serves as the elevation adjustment 28 for mechanism 10. Bolt 30 comprises a pivot point for such rotational movement. Normally, elevation adjustment 28 is determined and fixed during the operation of mechanism 10 by tightening bolt 26.

Azimuth adjustment means 32 includes a pair of pins 34 and 36 which extend from plate 22. A frame 38 holding antenna 12 includes ears 40 and 42 which fit within pins 34 and 36. It should be noted that the system depicted in FIG. 3 may be manually turned along the azimuth, however, motor means 43 may be employed to achieve such results, FIG. 3. Such motor means 43 may take the form of a ball screw actuator, approximately, 18 inches in length, manufactured by Thompson-Saginaw of Saginaw Michigan under the designation Actuator II. Motor 45 may be a 1/10 HP electric motor motivated by conventional electric power (not shown). Nevertheless, azimuth adjustment means 32 is of known construction found in the prior art.

Frame 38 is formed with a pentagonal member 44. A ring 46 pivotally connects to pentagonal member 44 through rotational members 48 and 50. With reference to rotatable member 50 on FIG. 1, it may be observed that rotational member 50 includes an armor pintle 52 and a gudgeon 54. Rotational member 48 is similarly constructed. Pair of ears 47 serve as a pivot for ball screw jack 43. Likewise, ears 49 on pentagonal member 44 may perform a similar function. Strap 51, anchored to plate 22, retains ball screw jack 43, also.

Figure 2:
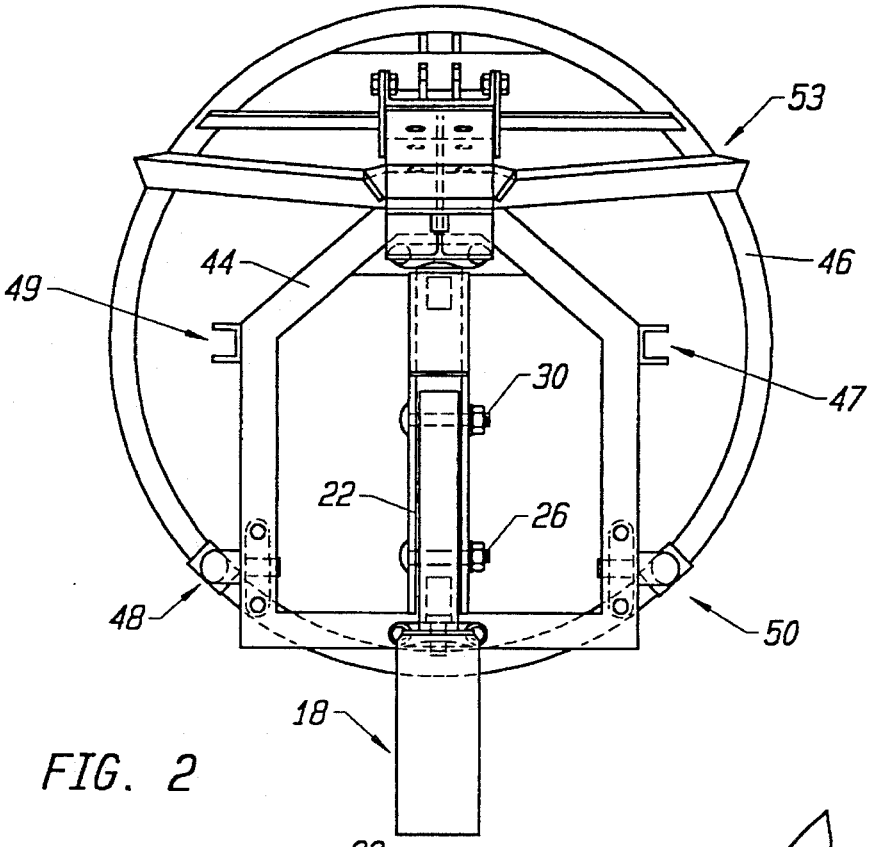
FIG. 2 is a rear elevational view of the mechanism of the present invention.
Figure 3:
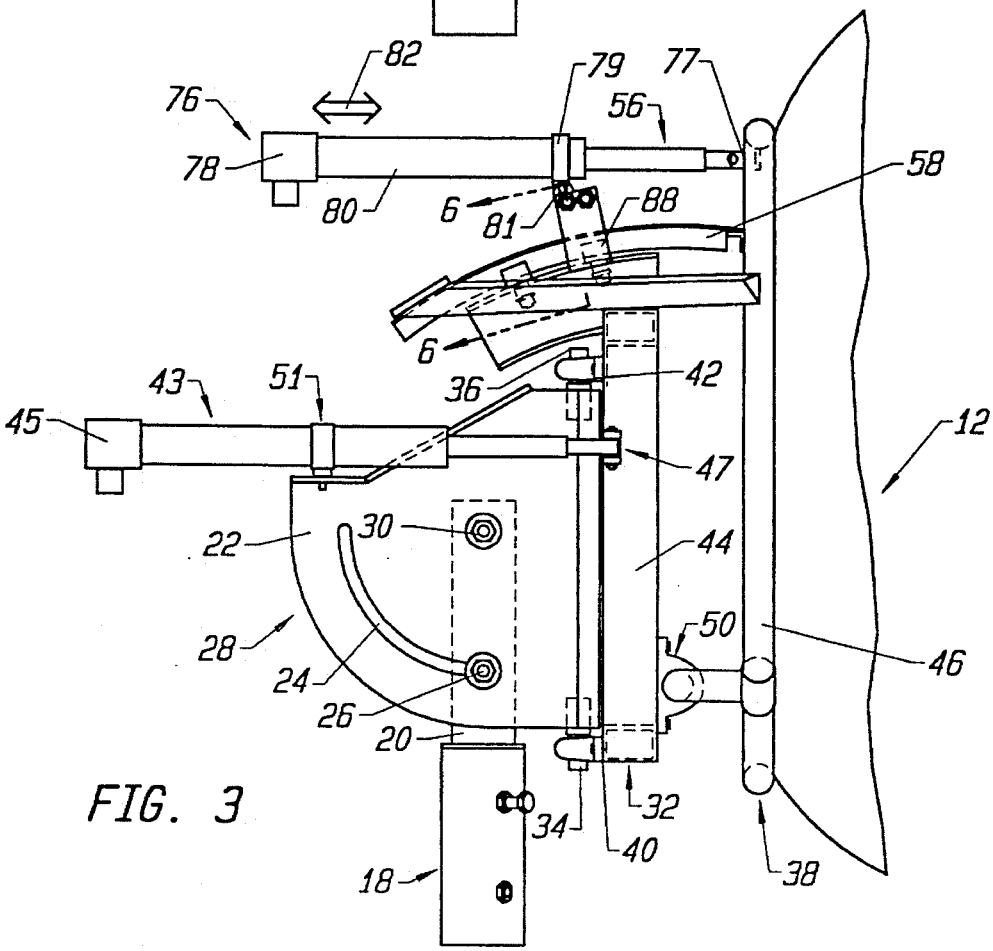
FIG. 3 is a side elevational view of the mechanism of the present invention, illustrating motorized azimuth and declination tracking.
Figure 4:
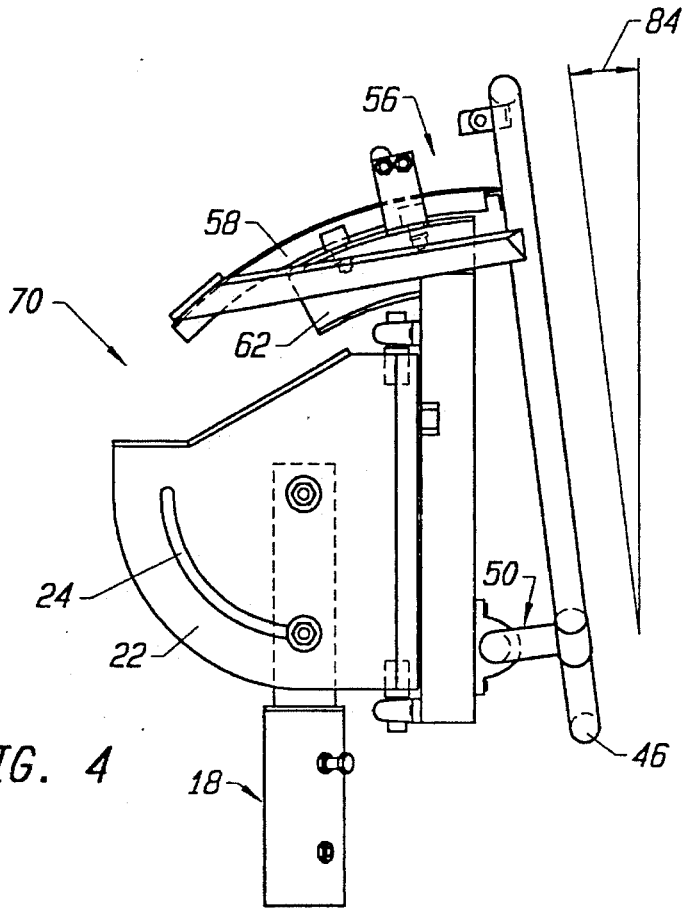
FIG. 4 is a side elevational view of the mechanism of the present invention in its maximum upward declination adjustment position.
Figure 5:
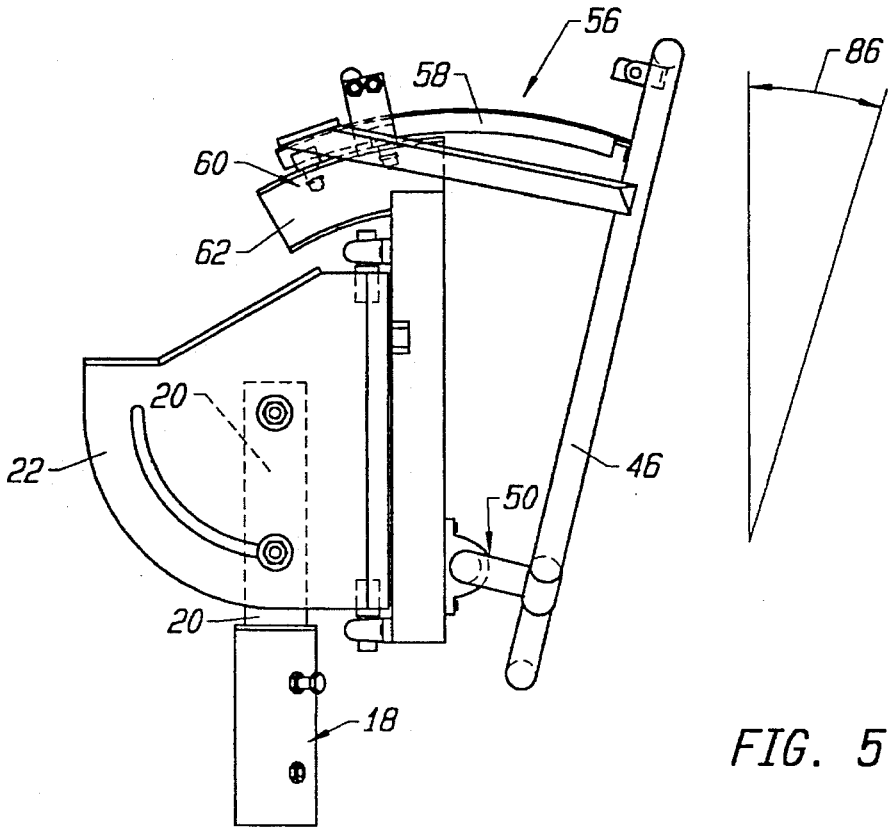
FIG. 5 is a side elevational view of the mechanism of the present invention in its maximum downward declination adjustment position.
Figure 6:
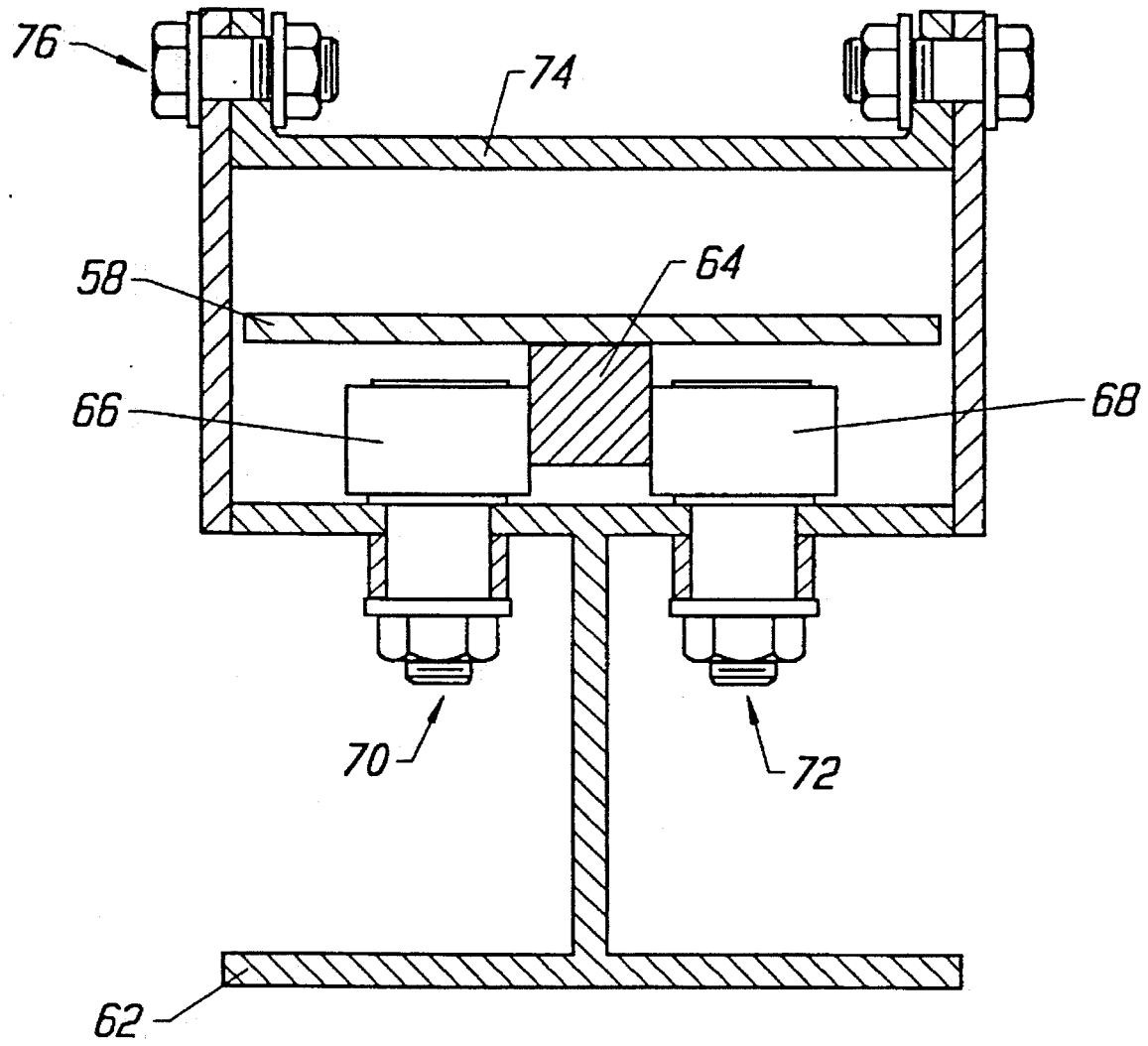
FIG. 6 is a sectional view taken along line 66 of FIG.

With reference to FIGS. 3, 4, and 5, it may observed that the mechanism of the present invention includes declination tracking orbit adjustment means 56. Declination tracking means 56 encompasses the rotational relationship between ring 46 holding antenna 12 and pentagonal member 44. In addition, declination tracking means 56 is formed with a track 58 which is of arcuate configuration. Track 58 is linked to ring 46 by welding, bolting, and the like via brackets 53, FIG. 2. A quartet of roller bearings 60 are fixed to curved beam 62 which underlies track 58. As depicted in FIG. 6, track 58 includes a central curved portion 64 which is capable of bearing on the rollers 66 and 68 of roller bearing 70 and 72. Curved plate 74 overlies track 64 and is held thereto by a multiplicity of bolts 76. Bearings 64 serve to guide the movement of track 58 during the declination adjustment of ring 46 and antenna 12.

Although declination adjustment means 56 may be manually adjusted, motivation means 76 is depicted in FIG. 3. Motivation means includes a motor 78 with a ball screw jack 80, similar to ball screw jack 43, that moves according to directional arrow 82. Pivot ear 77 on ring 46 and strap 79 connected to ear 81 support ball screw jack as shown on FIG. 3. Turning to FIGS. 4 and 5, it may be observed that ring 46 has been adjusted upwardly along a declination angle to its maximum level, about 7 degrees, while in FIG. 5 ring 46 and antenna 12 have been adjusted downwardly along a declination angle to its maximum, about 14 degrees. Antenna 12 has been removed from FIGS. 4 and 5 for the sake of simplicity. Angle 84 represents the upward declination movement of mechanism while angle 86 represents the downward declination movement of mechanism 10. Motor means and subsequently declination adjustment means 56 may be directed by a tracking controller (not shown) such as controller designated AutoTrak AC 2, manufactured by AstroDesign, Inc. of Phoenix, Ariz.

In operation, the user mounts poles 16 on a surface. The elevation is set according the latitude of the location of the antenna 12. Such elevation is fixed by tightening of bolt 26 after movement through arcuate slot 24 of plate 22 about pivot bolt 30. Azimuth adjustment means 32 is controlled by manually means or through a controller, as the case may be. In the case of the controller above identified, azimuth adjustment means 32 includes an motor means 43 similar to motivation means 76. Declination adjustment means 56 is also employed through the use of such controller such that antenna 12 connected to ring 46 rotates relative pentagonal member 44 in frame 38. Such rotational movement about rotational members 48 and 50 is achieved by the movement of track 58 relative to quartet of bearings 60. Ball screw jack 80 connected to motor 78 is capable of moving antenna 12 along an angle of declination, the maximum angles being represented by reference characters 84 and 86 in FIGS. 4 and 5. Mount 88 guides ball screw jack 80 in this endeavor.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A polar mounted antenna support mechanism comprising:

a. a frame for holding the antenna;

b. an azimuth adjusting element;

c. an elevation adjusting element; and d. a declination adjusting element including a track linked to said frame, a bearing surface for guiding movement of said track along an angle of declination, and motivation means for urging said movement of said track relative to said bearing surface.

2. The mechanism of claim 1 in which said track is curved.

3. The mechanism of claim 2 in which said declination adjusting element includes a pivot for said frame to permit rotation of said frame and to permit relative movement between said track and said bearing surface.

4. The mechanism of claim 3 in which said bearing surface includes at least a pair of rollers disposed on either side of said curved track, said rollers being held to a curved member adjacent said curved track.

5. The mechanism of claim 3 in which additionally comprises a curved flange overlying said curved track.

6. The mechanism of claim 5 in which said frame includes a ring-shaped mounting member, said ring-shaped mounting member being connected to said pivot and linked to said curved track.

7. A polar mounted antenna support comprising:

a. a frame for holding the antenna;

b. an azimuth adjusting element;

c. a declination adjusting element including a curved track linked to said frame, a curved flange overlying said curved track, a bearing surface for guiding movement of said track along an angle of declination, a pivot to permit rotation of said frame and to permit relative movement between said curved track and said bearing surface, and motivation means for urging movement of said track relative to said bearing surface, said motivation means comprising a motor held to said frame and a motor shaft connected to said frame for exerting force thereto.

8. An antenna mechanism for monitoring signals from satellite, supported by a frame having azimuth and elevation adjustments, comprising:

a declination adjusting element including a track linked to the frame and at least one roller capable of relative movement with respect to said track, and an antenna mount being capable of traveling along a declination angle according to a said relative movement between said track and said at least one roller.

9. The mechanism of claim 8 which additionally comprises motivation means for urging said relative movement between said track and said at least one roller.

10. The mechanism of claim 9 in which said track is curved.

11. The mechanism of claim 10 in which said declination adjusting element includes a pivot for said frame to permit rotation of said frame and relative movement between said track and said roller.

12. The mechanism of claim 11 in which said bearing surface includes at least a pair of rollers disposed on either side of said curved track, said rollers being held to a curved member adjacent said curved track.

13. The mechanism of claim 12 in which additionally comprises a curved flange overlying said curved track.

14. The mechanism of claim 13 in which said frame includes a ring-shaped mounting member, said ring-shaped mounting member being connected to said pivot and linked to said curved track.

* * * * *